United States Patent [19]

Albano

[11] 4,307,671

[45] Dec. 29, 1981

[54] MERCHANDISE SHELVING DISPLAY

[75] Inventor: Vincent J. Albano, Birmingham, Ala.

[73] Assignee: The Kent Corporation, Birmingham, Ala.

[21] Appl. No.: 146,799

[22] Filed: May 5, 1980

[51] Int. Cl.[3] ..... A47G 29/02

[52] U.S. Cl. ..... 108/6; 108/108; 248/242

[58] Field of Search ..... 108/6, 108; 248/242

[56] References Cited

U.S. PATENT DOCUMENTS

| | | | |
|---|---|---|---|
| 3,093,094 | 6/1963 | Oztekin | 248/242 |
| 3,182,945 | 5/1965 | Sedo | 248/242 |
| 3,199,821 | 8/1965 | Story | 248/242 |
| 3,300,170 | 1/1967 | Raffa | 248/242 |
| 3,346,226 | 10/1967 | Shell | 248/242 |
| 4,008,873 | 2/1977 | Travaglio et al. | 248/242 |
| 4,108,085 | 8/1978 | Shepherd et al. | 108/108 |

FOREIGN PATENT DOCUMENTS

| | | | |
|---|---|---|---|
| 780730 | 3/1968 | Canada | 248/242 |

*Primary Examiner*—Roy D. Frazier
*Assistant Examiner*—Peter A. Aschenbrenner
*Attorney, Agent, or Firm*—Woodford R. Thompson

[57] ABSTRACT

A shelf is supported by at least one shelf support from at least one vertical support having vertically spaced slots therein. The rear edge of each shelf support carries upper and lower extensions which fit into the slots. Abutting surfaces between the upper and lower extensions extend at angles to each other and abut, selectively, the adjacent surface of the vertical support. A downwardly opening notch in the lower edge of each upper extension engages the adjacent portion of its vertical support between the slots therein while the shelf is horizontal. An upstanding projection on the upper edge of each upper extension engages the adjacent portion of its vertical support between the slots therein while the shelf is tilted. Depending projections on the lower extensions abut adjacent portions of the vertical support between the slots therein while the shelf is horizontal and are adapted to move over the portions of the support between the slots upon upward movement of the rear portion of the shelf.

5 Claims, 6 Drawing Figures

MERCHANDISE SHELVING DISPLAY

BACKGROUND OF THE INVENTION

This invention relates to a merchandise shelving display and more particularly to such a display that is adapted to be positioned selectively at different angular positions relative to each other so that the shelves may display the merchanidse in a horizontal plane or in planes which are tilted relative to a horizontal position.

Heretofore in the art to which my invention relates, various types of adjustable shelf supports have been proposed for supporting a shelf at selected angular positions, such as the Oztekin U.S. Pat. No. 3.093,094. Difficulties have been encountered in the use of prior art shelf supports which are adjustable due to the fact that it is difficult to change positions of such supports quickly and easily without removing the shelf supports from their upright support members. Also, difficulties have been encountered in providing a positive lock between the shelf support and its vertical support member to eliminate entirely any chances of the shelf support becoming separated from its vertical support due to impact or abuse.

SUMMARY OF THE INVENTION

In accordance with my invention, I provide a shelf support which is detachably connected to a vertical support having vertically spaced slots therein. Upper and lower extensions are carried by the rear edge of the shelf support in position to fit into the slots in the vertical support. Two abutting surfaces between the upper and lower extensions extend at angles to each other and abut, selectively, the adjacent surface of the vertical support. The lower edge of each upper extension carries a downwardly opening notch which is adapted to engage the adjacent portion of the vertical support between the slots therein while the shelf is in a horizontal position. An upstanding projecting on the upper edge of each upper extension engages the adjacent portion of its vertical support between the slots therein while the shelf is in a pivoted position. The lower extension carry depending projections which abut the adjacent portions of the vertical support between the slots therein while the shelf is in a horizontal position and such depending projections are adapted to move over the portions of the support between the slots therein upon upward movement of the rear portion of the shelf.

An object of my invention is to provide a merchandise shelving display which shall include a shelf support having attaching extensions which are adapted to place a maximum amount of material into the vertically spaced slots provided in the upstanding supports for strength and are shaped so as to provide a drawer-like straight in slide with an abrupt drop to further provide an audible and positive lock which prevents dislodging and assurance of a positive latch in each selected position to prevent improper installation.

Another object of my invention is to provide a merchandise shelving display of the character designated in which upper extensions grip the mass of the upright support members between the slots therein to provide tension points in each position while lower extensions are used as compression points in the upper position of the shelf and are contoured to define a cam surface which passes through the slots in the upright supports in the tilted position to allow the curvature of the bottom edge of the lower extensions to act as a cam to raise and return the shelf support to the straight out or horizontal position upon applying a slight upward push at the front of the shelf.

A further object of my invention is to provide a shelf support of the character designated in which the tension points on the upper extensions are located on the the top edges of the upper extensions and the lower extensions are shaped so as to enter the slots in the upright supports when in the down position to thus form a finger-like lock to totally prevent dislodging of the shelf support from its upstanding support member.

DESCRIPTION OF THE DRAWINGS

Merchandise shelving displays embodying features of my invention are illustrated in the accompanying drawings, forming a part of this application, in which.

DETAILED DESCRIPTION

Figure 1:
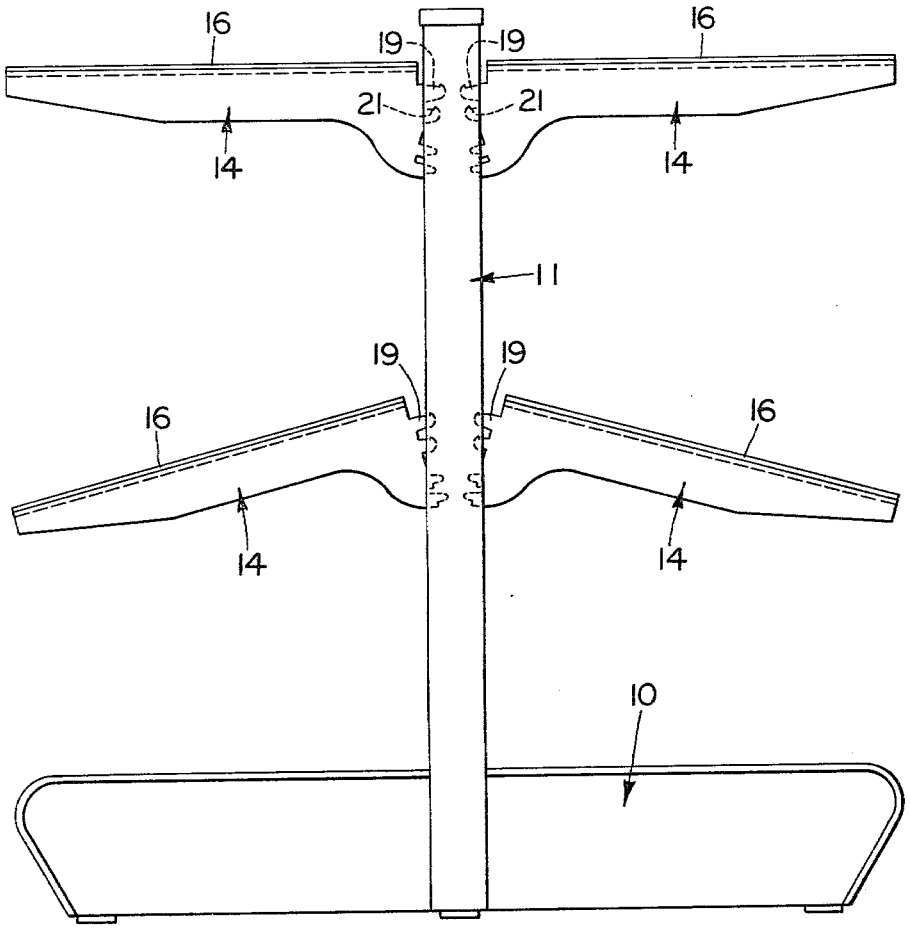
FIG. 1 is a side elevational view of the shelving display showing the two upper shelves supported in horizontal position and showing the two lower shelves supported in tilted position.
Figure 2:
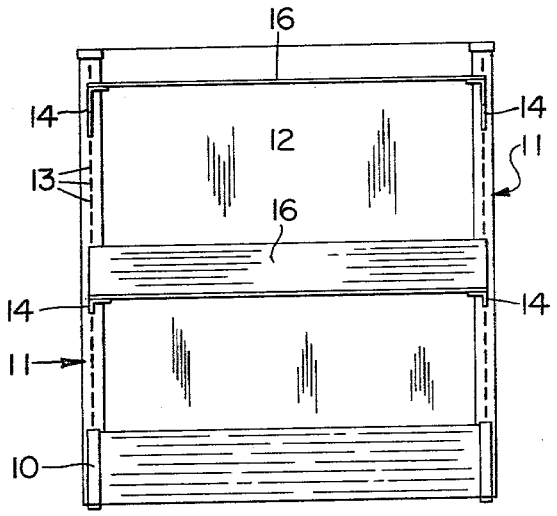
FIG. 2 is a front elevational view of the shelving display shown in FIG. 1, drawn to a smaller scale.

Referring now to the drawings for a better understanding of my invention, I show a merchandise shelving display embodying a supporting stand having a base 10 which carries vertical supports 11. The vertical supports 11 are shown as being spaced from each other and connected to opposite ends of a vertical plate-like member 12. Each vertical support 11 is provided with equally spaced, vertically elongated slots 13, as clearly shown in FIGS. 4, 5 and 6. Shelf supports, indicated generally at 14 are detachably connected to the vertical supports 11 by means of the vertically spaced slots 13 in a manner to be described hereinafter. As shown in FIGS. 1 and 2, shelves 16 extend between the shelf supports 14 and are secured thereto by suitable means, such as by welding.

Figure 3:
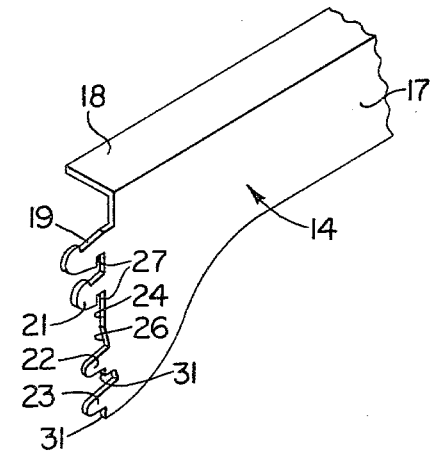
FIG. 3 is a perspective view, partly broken away, showing a shelf support removed from its upright support.
Figure 4:
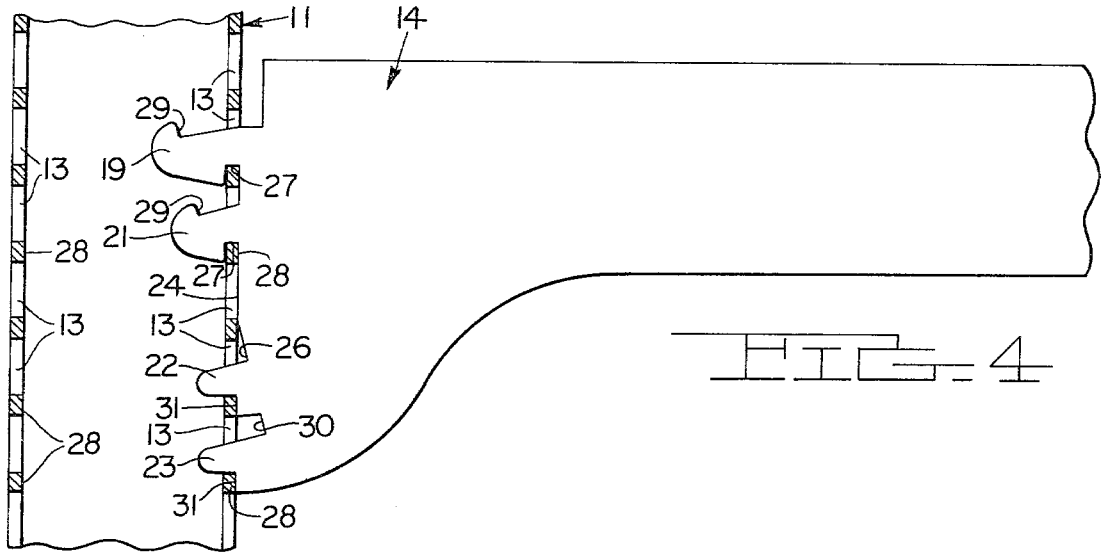
FIG. 4 is an enlarged, fragmental, sectional view through the upstanding support member showing a shelf support mounted for supporting merchandise in a horizontal plane.
Figure 5:
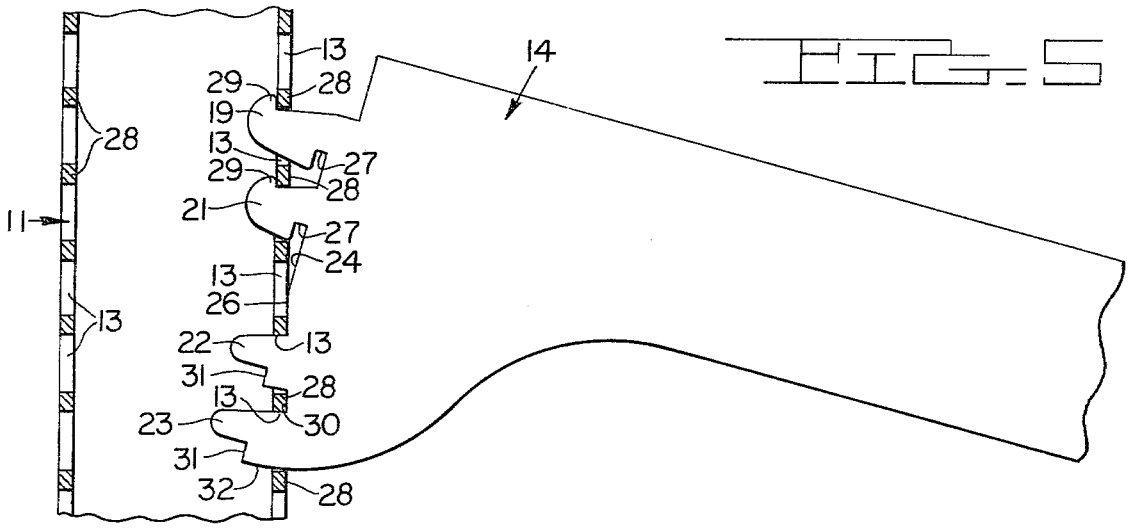
FIG. 5 is a fragmental view corresponding to FIG. 4 but showing the shelf support moved to a tilted position whereby it extends 15° from the horizontal; and, FIG. 6 is a fragmental view corresponding to FIGS. 4 and 5 showing a modified form of my invention with the shelf support being supported at an angle of approximately 18°.
Figure 6:
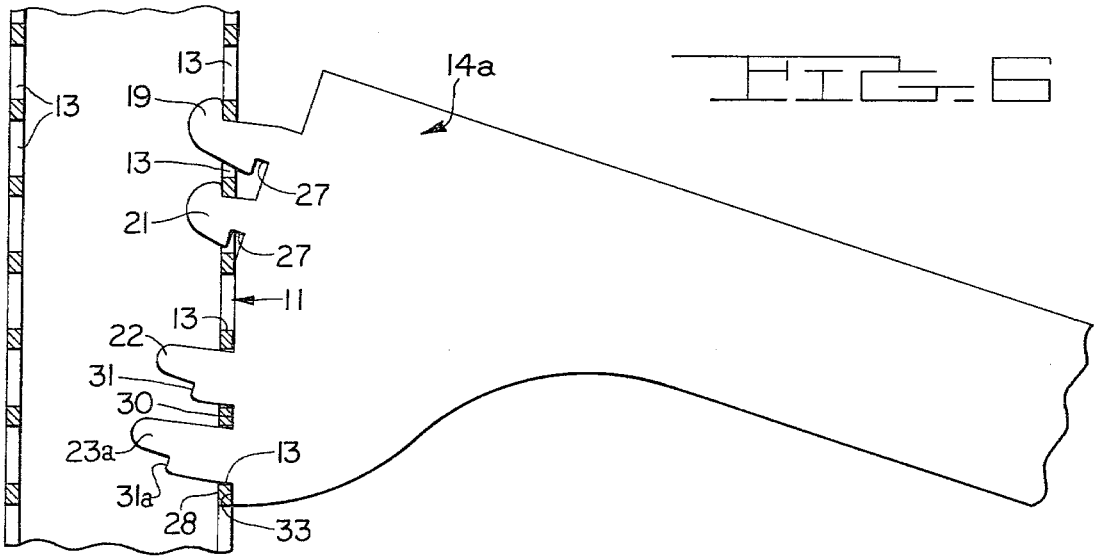

As shown in FIG. 3, each shelf support 14 may comprise a vertical web 17 which is formed integrally with a horizontally extending flange 18 along the upper edge thereof. The rear edge of each shelf support 14 is shown as having a pair of vertically spaced upper extensions 19 and 21 and a pair of vertically spaced lower extensions 22 and 23. As shown in FIGS. 4, 5 and 6, the upper and lower extensions fit into the vertically spaced slots 13. The rear edge of each of the shelf supports 14 is also provided with abutting surfaces 24 and 26 between the upper extension 21 and the lower extension 22 with the surfaces 24 and 26 extending at different angles to each other and adapted to abut, selectively, the adjacent surface of its associated vertical support 11. As shown in FIG. 4, the abutting surface 24 engages the vertical support 11 while the shelf support 14 extends in a horizontal position to thus support merchandise in a horizontal plane. When it is desired to support the shelf supports 14 in a tilted position, the shelf supports are moved to the position shown in FIG. 5 whereby the abutting surface 26 then engages the vertical support 11. In FIG. 5, the shelf support 14 is shown as being tilted downwardly and forwardly approximately 15°.

As shown in FIGS. 3, 4 and 5, a downwardly opening notch 27 is provided in the lower edge of each of the upper extensions 19 and 21 in position to engage the adjacent portion 28 of the vertical support 11 between the vertically spaced slots 13 while the shelf support 14 extends in a horizontal plane. Upstanding projections 29 are provided on the upper edge of each of the upper extensions 19 and 21 in position to engage the adjacent portion 28 of the vertical support 11 while the shelf supports 14 are supported at the tilted position shown in FIG. 5.

As shown in FIGS. 3, 4 and 5, the lower edge of each of the lower extensions 22 and 23 are provided with depending projections 31 in spaced relation to the rearmost ends thereof in position to abut the adjacent portion of the vertical support 11 while the shelf support 14 is at its horizontal position. As shown in FIG. 5, the depending projections 31 are adapted to move over the adjacent portion 28 of the vertical support 11 upon upward movement of the rear portion of the shelf support 14 to position the depending projections 31 at an elevation above the adjacent portion 28. An abutting surface 30 is provided between the lower extensions 22 and 23 in position to engage the vertical support 11 while the shelf support 14 is in the tilted position.

From the foregoing, it will be seen that while the shelf supports 14 are in the horizontal position, the downwardly opening notches 27 of the upper extensions 19 and 21 receive the subjacent portions 28 of the vertical supports 11 while the depending projections 31 carried by the lower extensions 22 and 23 abut the adjacent portions 28 of the vertical support 11 between the vertical slots 13. Also, while the shelf support 14 is in the horizontal position shown in FIG. 4, the abutting surface 24 on the rear edge of the shelf support engages the adjacent surface of the vertical support 11. The notches 27 in combination with the depending projections 31 and the abutting surface 24 provide a positive latch for each of the shelf supports 14 which not only prevent improper installation but prevents dislodging of the shelf support after installation. It will thus be seen that the notches 27 and the upstanding projections 29 carried by the upper extensions 19 and 21 provide a pair of vertically spaced tension points in both positions shown in FIGS. 4 and 5. That is, the downwardly opening notches 27 serve as tension points while in the horizontal position while the upstanding projections 29 serve as tension points while the shelf support 14 is in the tilted position. At the same time, the depending projections 31 serve as compression points while the shelf support 14 is in the upper position and the abutting surfaces 26 and 30 serve as compression points while the shelf support 14 is in the tilted position.

From the foregoing description, the operation of the shelf supports shown in FIGS. 1–5 will be readily understood. To install the shelf in the horizontal position, the upper and lower extensions carried by the shelf support 14 are inserted into the vertically spaced slots 13, as shown in FIG. 4 by merely moving the shelf supports 14 in a straight line, horizontal direction until the downwardly opening notches 27 move to a position to receive the portions 28 of the upstanding supports 11. In this position, the upper extensions 19 and 21 drop downwardly relative to the portions 28 to thus form a positive lock which insures proper installation and also prevents dislodging after installation.

To move the shelf support 14 from the horizontal supporting position to the tilted position shown in FIG. 5, a slight upward push is applied adjacent the rear of the shelf 16 to thus raise the rear portion of the shelf support 14 whereby the downwardly opening notches 27 move upwardly out of engagement with the subjacent portion 28 of the vertical support 11 whereupon the forward end of each shelf support 14 is free to move downwardly to the position shown in FIG. 5 whereupon the upstanding projections 29 engage the portions 28 adjacent thereto and the abutting surfaces 26 and 30 engage the adjacent surface of the vertical support 11 to thus secure the shelf supports 14 in the tilted position.

To move the shelf support from the tilted position shown in FIG. 5 to the horizontal position shown in FIG. 4, a slight push is applied adjacent the front of the shelf whereby the shelf supports 14 are moved upwardly from the position shown in FIG. 5 to the position shown in FIG. 4 whereupon the downwardly opening notches 27 then receive the portions 28 of the vertical support 11. The depending projection 31 of the lowermost extension 23 defines a cam surface 32 which engages the subjacent portion 28 of the vertical support 11 between the vertically spaced slots 13 and thus raises the rear portion of the shelf support 14 to return the shelf support to the horizontal position in response to upward movement of the front end of the shelf support 14.

Referring now to FIG. 6 of the drawings, I show a modified form of my invention wherein the shelf support, indicated at 14*a*, is provided with the upper extensions 19 and 21 and the lower extensions 22 having the depending projections 31, as described hereinabove. Also, an abutting surface 30 is provided between the lower extensions 22 and 23*a* in position to engage the vertical support 11 while the shelf support 14 is in the tilted position, as shown. The lowermost extension, indicated at 23*a*, is provided with a depending projection 31*a* which is identical to the depending projection 31 shown in FIGS. 4 and 5. An additional depending projection 33 is provided on the lower surface of the lower projection 23*a* in position to engage the adjacent portion 28 of the vertical support 11 while the shelf support 14*a* is in the tilted position shown in FIG. 6. The shelf support 14*a* is moved to the horizontal position and is retained in the horizontal position, as described hereinabove relative to the embodiment shown in FIGS. 1–5.

From the foregoing, it will be seen that I have devised an improved merchandise shelving display which is sturdy of construction and which may be changed quickly and easily to selected positions whereby the shelf may be supported in a horizontal plane or at selected angular positions relative to the horizontal. Also, by providing a shelf support which is positively locked in selected positions I not only prevent improper installation of the shelf supports but also prevent dislodging of the shelf supports from their vertical supports after installation. Furthermore, to move the shelf support from its lower tilted position to an upper position, one merely exerts a slightly upward push at the front of the shelf and to lower the shelf support from an upward position to a lower tilted position, one merely lifts the rear portion of the shelf support whereupon the forward end thereof moves downwardly to the tilted position.

While I have shown my improved shelf support as being attached to a pair of spaced apart vertical supports, it will be apparent that the shelf support may be supported by one or more vertical supports 11. Also, while I have shown the shelf support as being adapted for supporting a shelf in a horizontal position and at tilted positions at 15° and 18°, it will be apparent that the shelf supports may be supported at various other tilted positions.

While I have shown my invention in but two forms, it will be obvious to those skilled in the art that it is not so limited, but is susceptible of various other changes and modifications without departing from the spirit thereof.

What I claim is:

1. In a merchandise shelving display having at least one shelf supported from at least one vertical having vertically spaced slots therein, (a) at least one shelf support having a rear edge with at least one upper extension and at least one lower extension fitting in said slots with said rear edge having at least two abutting surfaces between said upper extension and said lower extension extending at different angles to each other and adapted to abut, selectively, the adjacent surface of said vertical support with one of said abutting surfaces engaging said vertical support at a horizontal position of said shelf support and the other engaging said vertical support at a tilted position of said shelf support, (b) there being a downwardly opening notch in the lower edge of said upper extension in position to engage the adjacent portion of said vertical support between said vertically spaced slots while said shelf support is at said horizontal position, (c) upstanding projections on the upper edge of said upper extension in position to engage the adjacent portion of said vertical support between said vertically spaced slots while said shelf support is at said tilted position, and (d) there being a depending projection on the lower edge of said lower extension in spaced relation to the rear end thereof in position to abut the adjacent portion of said vertical support between said vertically spaced slots while said shelf support is at said horizontal position and adapted to move over said adjacent portion of said vertical support between said vertically spaced slots upon upward movement of the rear portion of said shelf support to position said depending projection at an elevation above said adjacent portion of said vertical support between said vertically spaced slots.

2. A merchandise shelving display as defined in claim 1 in which a pair of vertically spaced upper extensions and a pair of vertically spaced lower extensions are carried by said rear edge of the shelf support in position to fit into said vertically spaced slots in said vertical support.

3. A merchandise shelving display as defined in claim 1 in which a second depending projection is carried by the lower edge of said lower extension in spaced relation to and forwardly of said first mentioned depending projection in position to abut an adjacent portion of said vertical support between said vertically spaced slots while said shelf support is at said tilted position.

4. A merchandise shelving display as defined in claim 1 in which said depending projection on the lower edge of said lower extension defines a cam surface which engages the adjacent portion of said vertical support between said vertically spaced slots and raises the rear portion of said shelf support to return said shelf support to said horizontal position in response to upward movement of the front of said shelf support.

5. A merchandise shelving display as defined in claim 1 in which the shelf is supported from two spaced apart vertical supports having said vertically spaced slots therein.

* * * * *